US008233645B2

(12) United States Patent
Kondo et al.

(10) Patent No.: US 8,233,645 B2
(45) Date of Patent: Jul. 31, 2012

(54) AUDIO SIGNAL OUTPUT APPARATUS, AUDIO SIGNAL OUTPUT METHOD, PROGRAM, AND RECORDING MEDIUM

(75) Inventors: Tetsujiro Kondo, Tokyo (JP); Junichi Shima, Tokyo (JP); Akihiko Arimitsu, Kanagawa (JP); Takuro Ema, Tokyo (JP)

(73) Assignee: Sony Corporation (JP)

( * ) Notice: Subject to any disclaimer, the term of this patent is extended or adjusted under 35 U.S.C. 154(b) by 791 days.

(21) Appl. No.: 12/319,435

(22) Filed: Jan. 7, 2009

(65) Prior Publication Data

US 2009/0175469 A1 Jul. 9, 2009

(30) Foreign Application Priority Data

Jan. 9, 2008 (JP) ..... P2008-002562

(51) Int. Cl.
*H04R 25/00* (2006.01)

(52) U.S. Cl. ..... 381/152; 381/303; 381/387

(58) Field of Classification Search ..... None
See application file for complete search history.

(56) References Cited

U.S. PATENT DOCUMENTS

2004/0223620 A1* 11/2004 Horbach et al. ..... 381/59
2007/0036366 A1* 2/2007 Konagai et al. ..... 381/61

FOREIGN PATENT DOCUMENTS

JP 2007-274132 A 10/2007

* cited by examiner

*Primary Examiner* — Benjamin Sandvik
*Assistant Examiner* — Leslie Pilar Cruz
(74) *Attorney, Agent, or Firm* — Lerner, David, Littenberg, Krumholz & Mentlik, LLP

(57) ABSTRACT

An audio signal output apparatus includes a driving unit and an output unit. The driving unit is configured to receive incident waves and generate a driving signal with the same phase as the incident waves. The output unit is configured to be driven by the driving signal and output waves with the same phase as the incident waves.

9 Claims, 10 Drawing Sheets

AUDIO SIGNAL OUTPUT APPARATUS, AUDIO SIGNAL OUTPUT METHOD, PROGRAM, AND RECORDING MEDIUM

CROSS REFERENCES TO RELATED APPLICATIONS

The present application claims priority from Japanese Patent Application No. JP 2008-002562, filed in the Japanese Patent Office on Jan. 9, 2008, the entire content of which is incorporated herein by reference.

BACKGROUND OF THE INVENTION

1. Field of the Invention

The present invention relates to an audio signal output apparatus that can be suitably applied to a flat panel speaker apparatus in particular, an audio signal output method used in the audio signal output apparatus, a program, and a recording medium.

2. Description of the Related Art

When music is performed on a stage or the like, it is common to use acoustic reflectors to improve the acoustic reflectance of the space. By using acoustic reflectors, it is possible to reflect sound, which would otherwise escape upward or to the rear of the stage if reflectors were not used, toward the front where the audience is situated.

In recent years, the characteristics of such acoustic reflectors have also been utilized to reflect sound outputted from directional loudspeakers and thereby control the sound field of a specific range.

For example, Japanese Unexamined Patent Application Publication No. 2007-274132 discloses a technology that increases the area of an acoustic reflector in accordance with the distance from a sound source to prevent attenuation of sound at a location distant from the sound source.

SUMMARY OF THE INVENTION

However, since an acoustic reflector is intended to correct the acoustic characteristics of a given space, operations that change the reflectance characteristics of an acoustic reflector in accordance with the application of the acoustic reflector have not been carried out in the past. Therefore, when a user wishes to change the amount of sound reflected by an acoustic reflector, for example, as disclosed in Japanese Unexamined Patent Application Publication No. 2007-274132, control to vary the size of the acoustic reflector or the like has been carried out.

However, to make the size of an acoustic reflector variable, it may be necessary to amend the construction of the acoustic reflector itself. As a result, manufacturing costs may increase. Also, in order to control sound at a specific listening point reached by sound outputted from a given sound source, it has been necessary to provide a dedicated acoustic reflector as a tool for obtaining such effect.

It is desirable to control a sound field of a specific range without providing a dedicated acoustic reflector.

According to an embodiment of the present invention, there is provided an audio signal output apparatus including: a driving unit configured to receive incident waves and generate a driving signal with the same phase as the incident waves; and an output unit configured to be driven by the driving signal and output waves with the same phase as the incident waves.

With this construction, waves are outputted based on the driving signal generated upon receiving the incident waves.

According to an embodiment of the present invention, since the output waves are outputted based on a driving signal generated upon receiving incident waves, in a sound field of a specific range reached by the output waves, the volume of sound transferred by the incident waves and the output waves can be controlled.

By applying the audio signal output apparatus to a flat panel speaker apparatus, even when a dedicated sound reflector is not provided, it is possible to obtain a similar or greater sound reflecting effect as when an acoustic reflector is used.

DESCRIPTION OF THE PREFERRED EMBODIMENTS

Figure 1:
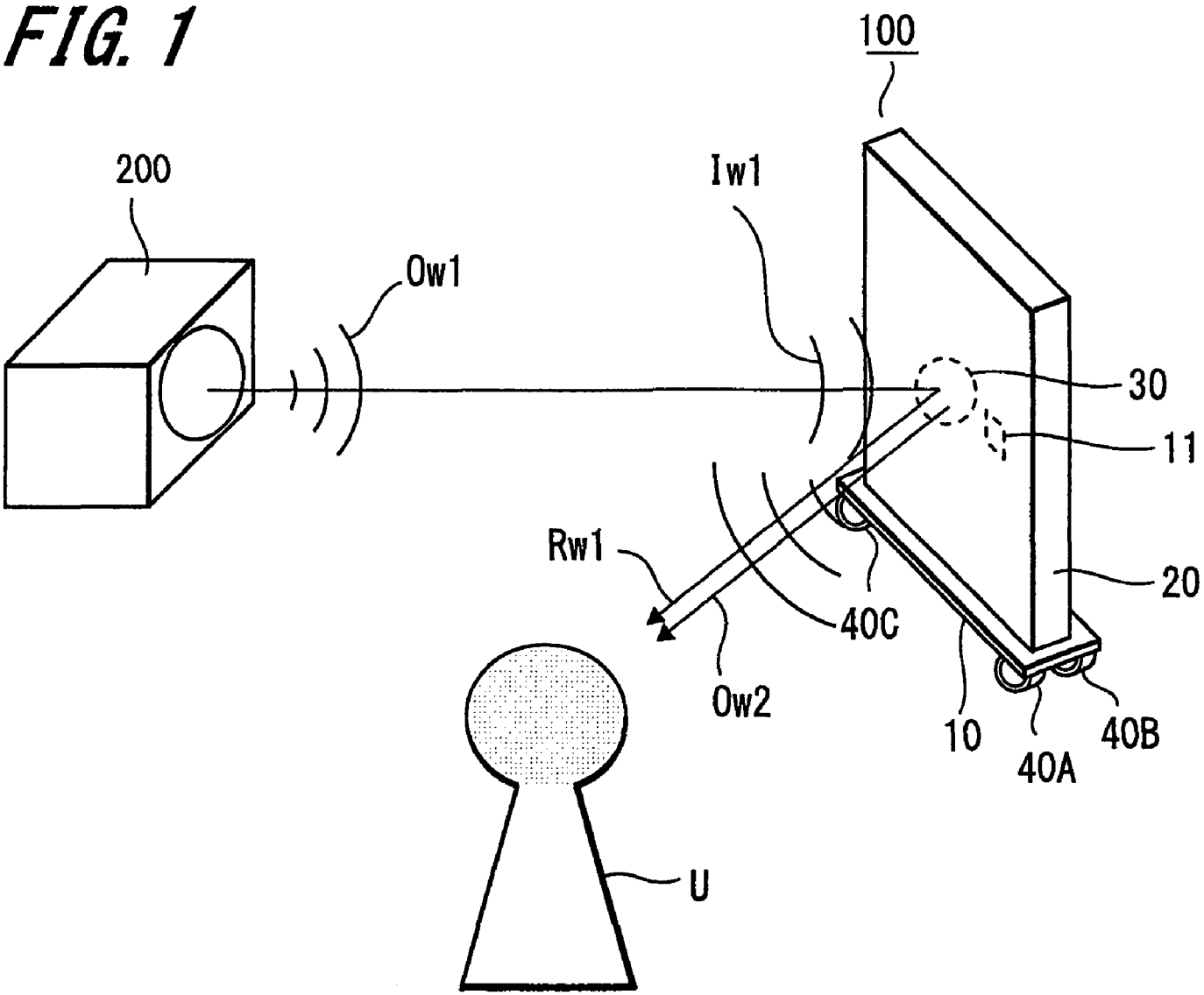
FIG. 1 is a diagram showing an example construction of a system according to a first embodiment of the present invention.
Figure 2:
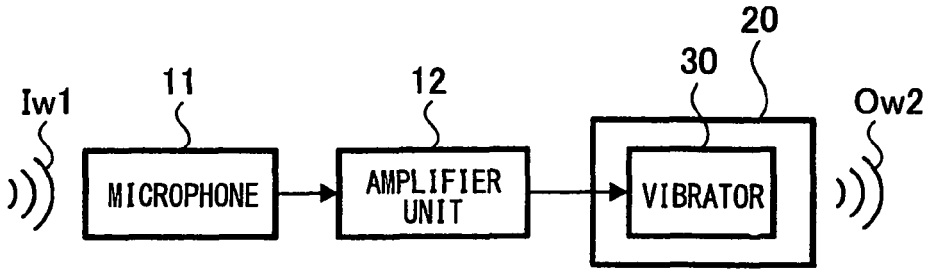
FIG. 2 is a block diagram showing an example of the internal configuration of a flat panel speaker apparatus according to a first embodiment of the present invention.
Figure 3:
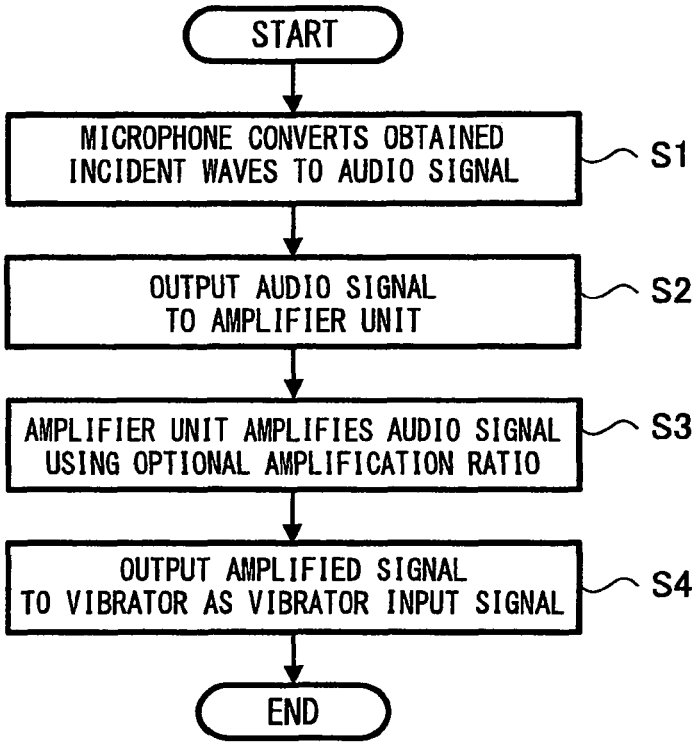
FIG. 3 is a flowchart that shows an example of vibrator input signal generating processing according to a first embodiment of the present invention.

A first embodiment of the present invention will now be described with reference to FIGS. 1 to 3. In the present embodiment, an audio signal output apparatus is applied to a flat panel speaker apparatus. FIG. 1 shows an example construction of a system including a flat panel speaker apparatus 100 and a fixed-position speaker apparatus 200.

In this system, the user U is positioned at a location reached by reflected waves Rw1 produced when the output waves Ow1 outputted from the speaker apparatus 200 are reflected by the flat panel speaker apparatus 100 so that the user will be able to hear a reflection of the sound outputted from the speaker apparatus 200. In the present embodiment, the flat panel speaker apparatus 100 not only physically reflects incident waves Iw1 but also carries out processing of outputting a signal, which has been produced by amplifying a signal generated upon receiving the incident waves Iw1 by a predetermined amplification ratio without changing the phase, as output waves Ow2.

The speaker apparatus 200 includes a speaker unit and an amplifier unit (neither is shown), amplifies an audio signal inputted from a reproduction apparatus such as a CD (Compact Disc) player or a DVD (Digital Versatile Disc) player, and outputs the amplified signal as sound from the speaker unit. As the speaker apparatus 200, it is possible to use a product commercially available.

The flat panel speaker apparatus 100 includes a base 10, a vibration member 20, a vibrator 30, wheels 40A to 40D (in FIG. 1, wheel 40D is omitted), and a microphone 11 as an incident wave obtaining unit. As an example, the base 10 may be formed from a metal such as steel, aluminum, magnesium, or titanium. The base 10 may alternatively be formed from a lightweight material such as plastic. The vibration member 20 is attached to an upper side of the base 10 by welding or the like so that the vibration member 20 is vertically erected on the base 10. That is, the flat panel speaker apparatus 100 also functions as a screen that extends to a predetermined height from the floor. The flat panel speaker apparatus 100 also includes an audio signal input unit, not shown, and in the same way as the speaker apparatus 200, can also function as a normal speaker.

The vibration member 20 is formed in a sheet-like form from a material such as plasterboard, a wood material like MDF (Medium Density Fiberboard), an aluminum plate, carbon, acrylic or other resin, and glass. The vibration member 20 may alternatively be formed from a composite material where different materials are combined (laminated).

The vibrator 30 is attached inside the vibration member 20. The vibrator 30 causes the vibration member 20 to vibrate upon receiving an audio signal inputted from an amplifier unit, not shown. By causing the vibration member 20 to vibrate, sound is outputted from the vibration member 20. The amplifier unit receives an audio signal inputted from an audio signal input unit, not shown, or an audio signal outputted from the microphone 11.

The four wheels 40A to 40D are attached at four corners on the lower side of the base 10, and when the flat panel speaker apparatus 100 is pushed by the user, the four wheels 40A to 40D rotate on the floor surface so that the flat panel speaker apparatus 100 can move in the direction in which the user is pushing the flat panel speaker apparatus 100. Note that although an example where the flat panel speaker apparatus 100 is constructed so as to be movable using the four wheels 40A to 40D is given in the present embodiment, according to another embodiment a flat panel speaker apparatus may not have wheels.

The microphone 11 is attached to the periphery of a center position inside the vibration member 20. The microphone 11 picks up the incident waves Iw1 on the vibration member 20 and converts the waves Iw1 to an audio signal and outputs the audio signal to a later-described amplifier unit.

Here, an example of the internal configuration of the flat panel speaker apparatus 100 will be described with reference to FIG. 2. FIG. 2 is a block diagram showing an example of the components that relate to processing from the processing of the sound waves (the incident waves Iw1) incident on the vibration member 20 to the output of the processed waves as output waves, and therefore shows the microphone 11, an amplifier unit 12, the vibrator 30, and the vibration member 20.

Since the microphone 11, the vibrator 30, and the vibration member 20 were described earlier with reference to FIG. 1, description thereof is omitted here. The amplifier unit 12 amplifies the audio signal outputted from the microphone 11 at a predetermined amplification ratio without changing the phase and supplies the amplified signal into the vibrator 30 as a vibrator input signal. That is, in the present embodiment, the amplifier unit 12 also functions as a unit generating a driving signal that drives the vibrator 30. The amplification ratio of the amplifier unit 12 can be set at any value of one or higher.

The vibrator 30 is driven by the vibrator input signal and vibrates, with such vibration also being transmitted to the vibration member 20. Due to the vibration member 20 vibrating, the output waves Ow2 are outputted from the flat panel speaker apparatus 100.

An example of processing by the components described above is shown in the flowchart in FIG. 3. In FIG. 3, first, the incident waves Iw1 incident on the vibration member 20 are obtained by the microphone 11 and converted to an audio signal (step S1) and the generated audio signal is outputted to the amplifier unit 12 (step S2). Next, the amplifier unit 12 amplifies the inputted audio signal by a predetermined amplification ratio (step S3) and the amplified audio signal is outputted to the vibrator 30 as the vibrator input signal (step S4).

That is, the sound waves outputted from the vibration member 20 have the same phase as the sound waves outputted from the speaker apparatus 200 and have an adjusted amplification ratio. As shown in FIG. 1, (i) the output waves Ow1 outputted from the speaker apparatus 200, (ii) the reflected waves Rw1 obtained by the flat panel speaker apparatus 100 reflecting the output waves Ow1, and (iii) the output waves Ow2 generated from an audio signal with an adjusted amplification ratio and the same phase as the sound waves outputted from the speaker apparatus 200 all reach the position of the user U.

Accordingly, by setting the amplification ratio of the amplifier unit 12 inside the flat panel speaker apparatus 100 at a high value, the amplification of the output waves Ow2 is increased. That is, by increasing the amplification ratio of the amplifier unit 12, it is possible to increase the reflectance of the vibration member 20.

According to the first embodiment described above, it is possible to also use the flat panel speaker apparatus 100 as an acoustic reflector where the reflectance for incident waves Iw1 can be optionally changed. That is, by setting the amplification ratio of the amplifier unit 12 inside the flat panel speaker apparatus 100 at a desired value, it is possible to optionally adjust the reflectance when the flat panel speaker apparatus 100 is used as an acoustic reflector. As a result, it is possible to obtain an acoustic reflector whose reflectance can be easily adjusted.

When the user is positioned at a location far from the speaker apparatus 200, it is possible to compensate for attenuation of the audio signal due to such distance by increasing the amplification ratio of the amplifier unit 12. That is, it is possible to eliminate difficulty of the user U clearly hearing sound depending on the distance from the sound source (the speaker apparatus 200 in the present embodiment).

When the user U is elderly and has impaired hearing, for example, it is possible to increase the volume of the sound that reaches the position of the user U by setting the amplification ratio of the amplifier unit 12 at a high value. By doing so, it is possible to eliminate difficulty of the user U clearly hearing the sound. Accordingly, by using the flat panel speaker apparatus 100 according to the present embodiment, the volume of the sound that can be heard by the user U can be adjusted in accordance with the user U's hearing.

Note that although an example where the microphone 11 is used as a device for detecting the incident waves Iw1 has been described above in the first embodiment, the device of detecting the incident waves Iw1 is not limited thereto, and as another example an accelerometer or the like may be used.

Figure 4:
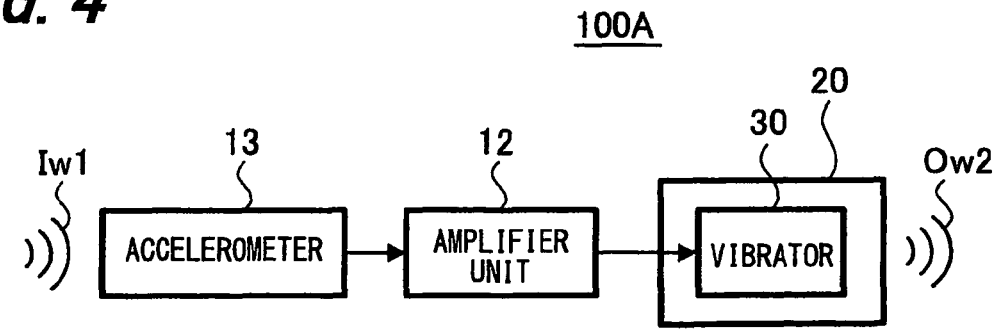
FIG. 4 is a block diagram showing a modified example of the internal configuration of a flat panel speaker apparatus according to a first embodiment of the present invention.

FIG. 4 shows an example configuration where an accelerometer 13 is used in a flat panel speaker apparatus 100A. In FIG. 4, parts that correspond to parts in FIG. 2 have been assigned the same reference numerals. In FIG. 4, the accelerometer 13 obtains vibrations of the vibration member 20 caused by the incident waves Iw1, and converts the obtained vibrations to a displacement signal. The generated displacement signal is outputted to the amplifier unit 12. The amplifier unit 12 amplifies the displacement signal outputted from the accelerometer 13 by a predetermined amplification ratio without changing the phase of the displacement signal and inputs the amplified signal into the vibrator 30 as the vibrator input signal.

The operation hereafter is the same as in the operation described above with reference to FIG. 2. That is, the vibrator 30 is driven by the vibrator input signal and vibrates, with such vibration also being transmitted to the vibration member 20. Due to the vibration member 20 vibrating, the output waves Ow2 are outputted from the flat panel speaker apparatus 100A.

According to the modified example of the first embodiment described above, since the vibrations of the vibration member 20 vibrated by the incident waves Iw1 can be directly obtained by the accelerometer 13, the detection result for the incident waves is more accurate than when the microphone 11 is used.

Note that although constructions where the output waves outputted from the speaker apparatus 200 are detected by the microphone 11 and the accelerometer 13 are given in the first embodiment and the modification thereof described above, it is also possible to use a configuration where an input audio signal inputted into the speaker apparatus 200 that is the source of the output waves is also inputted into a flat panel speaker apparatus 100B. One example configuration of the flat panel speaker apparatus 100B in such case is shown in FIG. 5.

Figure 5:
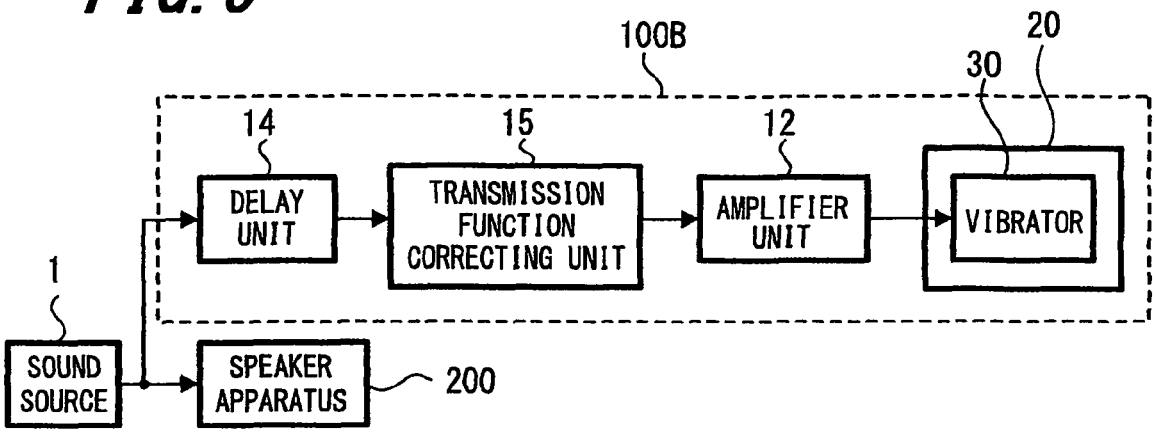
FIG. 5 is a block diagram showing a modified example of the internal configuration of a system according to a first embodiment of the present invention.

In FIG. 5, an audio signal outputted from a sound source 1 that is a reproduction apparatus or the like is inputted into both the speaker apparatus 200 and the flat panel speaker apparatus 100B. The flat panel speaker apparatus 100B shown in FIG. 5 includes a delay unit 14, a transmission function correcting unit 15, the amplifier unit 12, the vibrator 30, and the vibration member 20.

In this example, the time from (i) the input of the audio signal from the sound source 1 to the speaker apparatus 200 to (ii) output waves produced by outputting such audio signal being incident on the vibration member 20 of the flat panel speaker apparatus 100B is calculated in advance. The time from the input of the audio signal into the flat panel speaker apparatus 100B to the output of the output waves Ow2 from the vibration member 20 generated upon receiving such audio signal is then set so as to match the calculated time. More specifically, processing of adding a predetermined delay to the audio signal inputted into the flat panel speaker apparatus 100B is carried out.

Accordingly, the timing at which the output waves Ow2 are outputted from the flat panel speaker apparatus 100B is adjusted. Also, the output timing of the output waves Ow2 and the generation timing of the reflected waves Rw1 when the incident waves Iw1 from the speaker apparatus 200 are actually reflected become substantially equal, so that the output signal phase matches. The delay is added by the delay unit 14 shown in FIG. 5. The delay unit 14 adds a delay calculated in advance to the audio signal inputted from the sound source 1 and outputs the audio signal, to which the delay is applied, to the transmission function correcting unit 15.

The transmission function correcting unit 15 carries out processing of correcting a transmission function that reproduces the transmission characteristics of sound in the space through which the output waves Ow1 from the speaker apparatus 200 propagate before being incident on the flat panel speaker apparatus 100B. More specifically, the transmission function correcting unit 15 calculates the transmission function in advance and uses the transmission function to correct the audio signal outputted from the delay unit 14. The corrected audio signal is outputted to the amplifier unit 12.

The amplifier unit 12 amplifies the audio signal outputted from the transmission function correcting unit 15 by a predetermined amplification ratio without changing the phase of the audio signal, and inputs the amplified signal into the vibrator 30 as the vibrator input signal. The vibrator 30 is driven by the vibrator input signal and vibrates, with such vibration also being transmitted to the vibration member 20. Due to the vibration member 20 vibrating, the output waves Ow2 are outputted from the flat panel speaker apparatus 100B.

Figure 6:
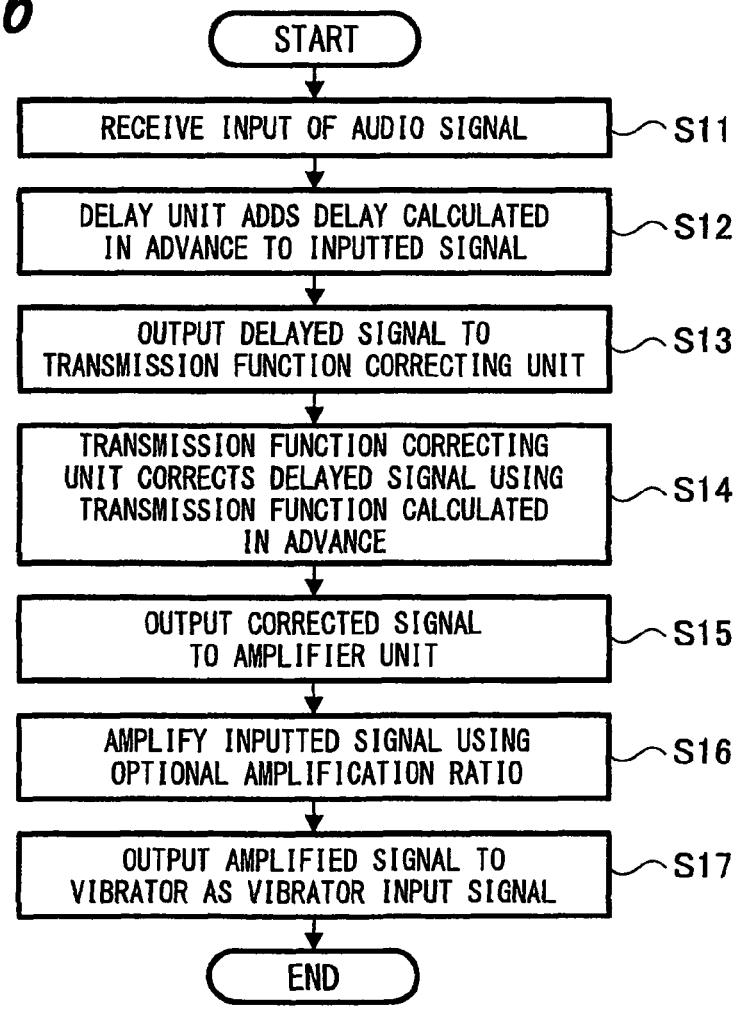
FIG. 6 is a flowchart that shows a modified example of the vibrator input signal generating processing according to a first embodiment of the present invention.

FIG. 6 is a flowchart showing an example of processing from the input of the audio signal from the sound source 1 to the generation of the vibrator input signal. First, when the audio signal outputted from the sound source 1 is inputted into the flat panel speaker apparatus 100B (step S11), the audio signal is inputted into the delay unit 14. The delay unit 14 adds a delay calculated in advance to the inputted audio signal (step S12) and the delayed audio signal is outputted to the transmission function correcting unit 15 (step S13).

The transmission function correcting unit 15 corrects the audio signal delayed using the transmission function (step S14). The corrected audio signal is outputted to the amplifier unit 12 (step S15). The amplifier unit 12 amplifies the audio signal by a predetermined amplification ratio (step S16) and the amplified audio signal is outputted as a vibrator input signal to the vibrator 30 (step S17).

According to the modified example of the first embodiment described above, it is possible to directly process an audio signal inputted from the sound source 1. That is, adjustments such as the adding of a delay to the audio signal inputted from the sound source 1 and the correction of the transmission function can be carried out before the output waves outputted from the speaker apparatus 200 reach the flat panel speaker apparatus 100B. Accordingly, output waves produced by an audio signal adjusted using the delay, the transmission function, and the like can be outputted from the flat panel speaker apparatus 100B at substantially the same timing as the timing at which the output waves from the speaker apparatus 200 are reflected by the flat panel speaker apparatus 100B.

Therefore, according to the above-described configuration, in addition to the effects of the first embodiment described above, it is possible to obtain an effect of making the sound that reaches the position of the user U from the flat panel speaker apparatus 100B sound more natural.

Figure 7:
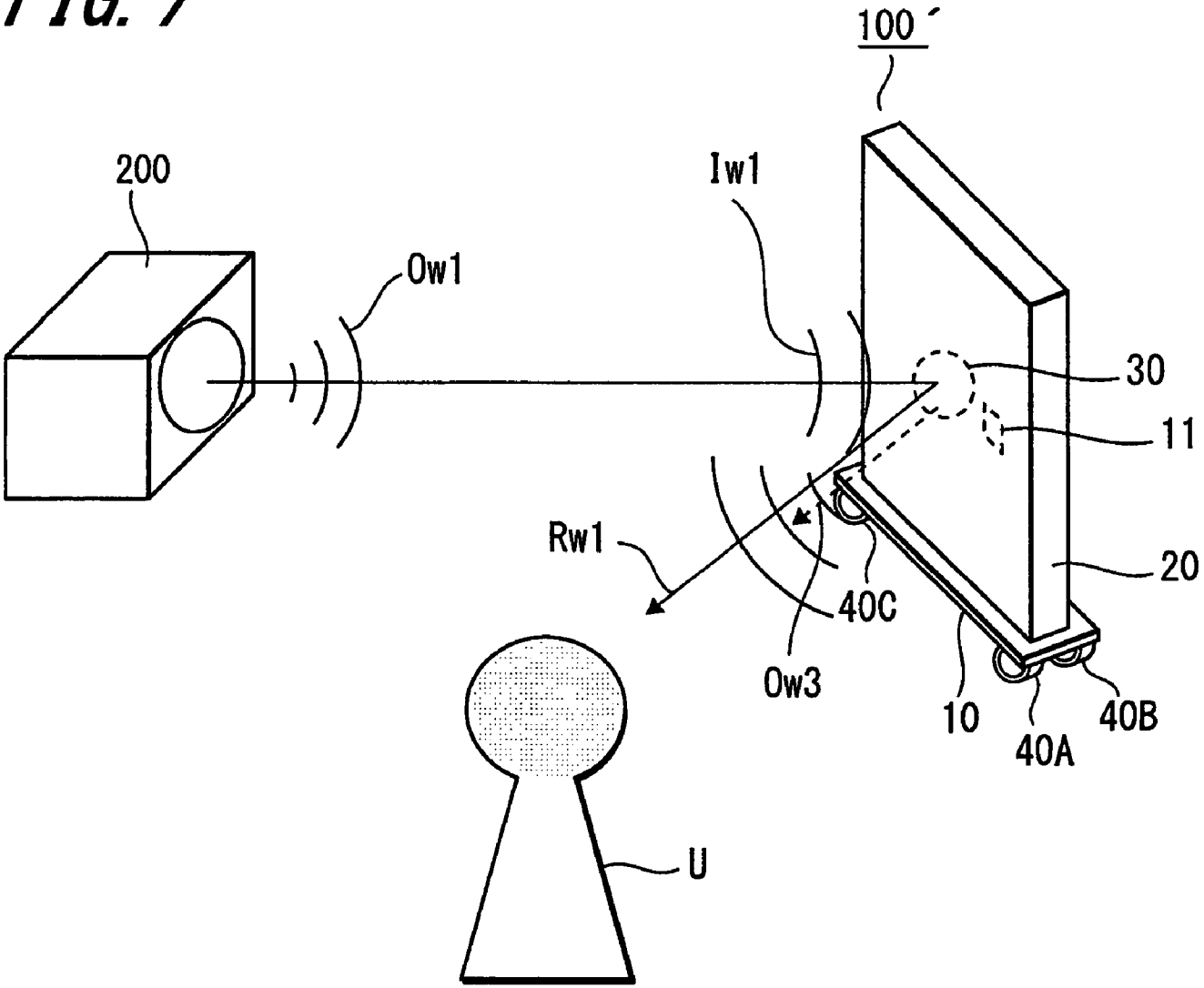
FIG. 7 is a diagram showing an example construction of a system according to a second embodiment of the present invention.

Next, a second embodiment of the present invention will be described with reference to FIGS. 7 to 9. As shown in FIG. 7, in the second embodiment, a predetermined delay is added to the incident waves Iw1 that are incident on a flat panel speaker apparatus 100' and the result is outputted as output waves Ow3. Thus, sound waves (the reflected waves Rw1) produced by the flat panel speaker apparatus 100' reflecting the incident waves Iw1 reach the position of the user U first and then the output waves Ow3 will arrive after a delay. That is, the output waves Ow3 are heard as a reverberation (i.e., an echo).

Figure 8:
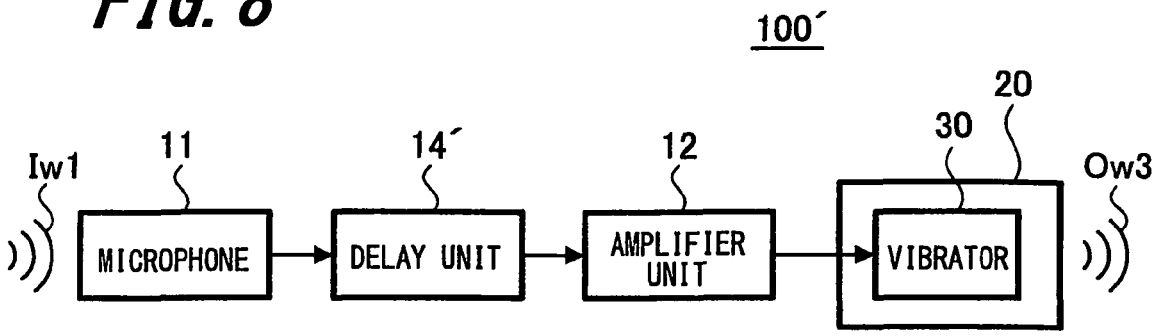
FIG. 8 is a block diagram showing an example of the internal configuration of a flat panel speaker apparatus according to a second embodiment of the present invention.

FIG. 8 shows an example of the internal configuration of the flat panel speaker apparatus 100' according to the present embodiment. In FIG. 8, parts that correspond to parts in FIGS. 2, 4, and 5 have been assigned the same reference numerals. The microphone 11 picks up the incident waves Iw1 incident on the vibration member 20, converts the waves to an audio signal, and outputs the audio signal to a delay unit 14'.

The delay unit 14' adds a delay set in advance or a delay set by the user U to the audio signal outputted from the microphone 11 and outputs the delayed audio signal to the amplifier unit 12. The amplifier unit 12 amplifies the audio signal outputted from the delay unit 14' at a predetermined amplification ratio without changing the phase and inputs the amplified signal into the vibrator 30 as the vibrator input signal.

The vibrator 30 is driven by the vibrator input signal and vibrates, with such vibration also being transmitted to the vibration member 20. Due to the vibration member 20 vibrating, the output waves Ow3 are outputted from the flat panel speaker apparatus 100'. That is, the output waves Ow3 are outputted from the flat panel speaker apparatus 100' later than the reflection of the reflected waves Rw1 produced by the incident waves Iw1 on the vibration member 20.

Figure 9:
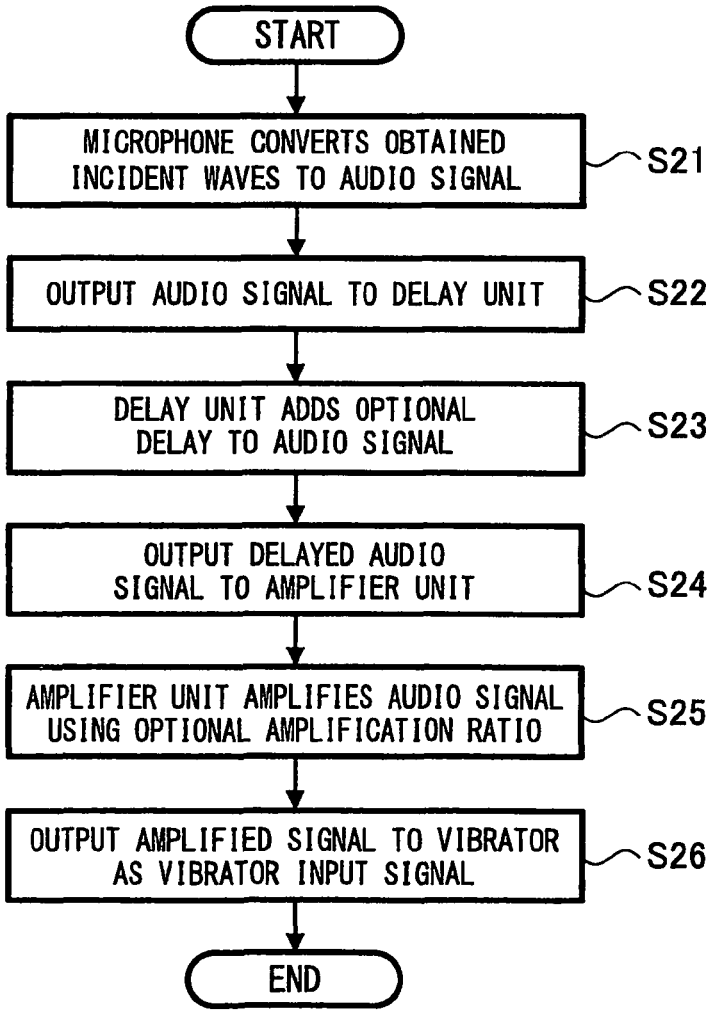
FIG. 9 is a flowchart that shows an example of vibrator input signal generating processing according to a second embodiment of the present invention.

FIG. 9 is a flowchart showing an example of the processing from the detection of incident waves Iw1 by the microphone 11 to the generation of the vibrator input signal. First, the incident waves Iw1 are detected by the microphone 11 and converted to the audio signal (step S21) and the generated audio signal is outputted to the delay unit 14' (step S22). The delay unit 14' adds a delay to the audio signal (step S23) and the delayed audio signal is outputted to the amplifier unit 12 (step S24). The amplifier unit 12 amplifies the audio signal by a predetermined amplification ratio (step S25) and the amplified audio signal is outputted as a vibrator input signal to the vibrator 30 (step S26).

According to the second embodiment described above, the flat panel speaker apparatus 100' functions as an acoustic reflector for the speaker apparatus 200 and also has a function of generating a reverberation. In this case, by adjusting the length of the delay in the delay unit 14', it is possible to adjust the output timing of the reverberation. That is, it is possible to generate a desired echo.

Next, a third embodiment of the present invention will be described with reference to FIG. 10. In this third embodiment, there are a plurality of sound sources 1 for the speaker apparatus 200 and a flat panel speaker apparatus 100B configured to be capable of reflecting the respective audio signals with different reflectance.

Figure 10:
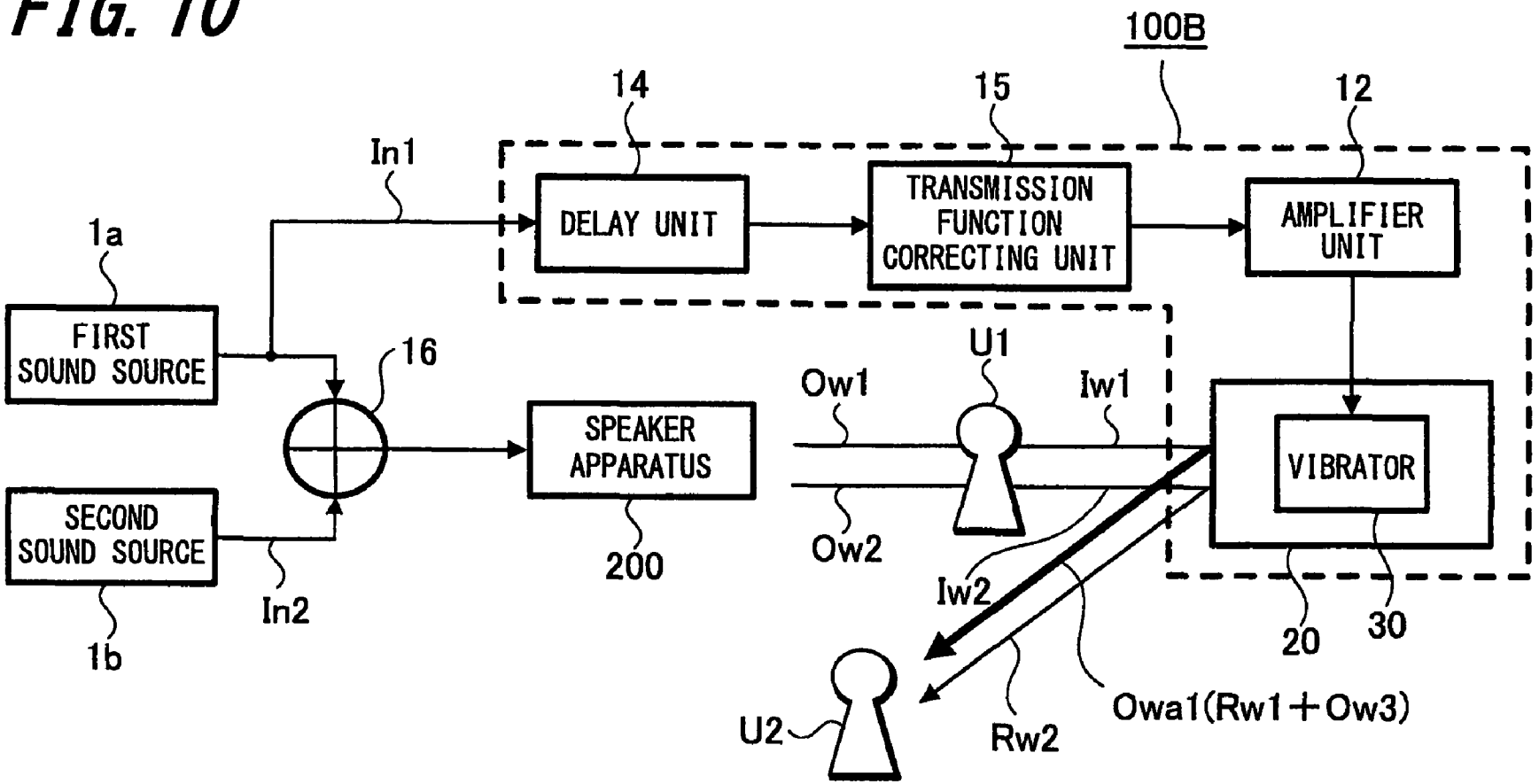
FIG. 10 is a diagram showing an example construction of a system according to a third embodiment of the present invention.

The system shown in FIG. 10 includes a first sound source 1*a*, a second sound source 1*b*, an adding unit 16, the speaker apparatus 200, and the flat panel speaker apparatus 100B. The first sound source la and the second sound source 1*b* output different audio signals, respectively. The adding unit 16 adds the first audio signal In1 outputted from the first sound source 1*a* and the second audio signal In2 outputted from the second sound source 1*b* and outputs the added result to the speaker apparatus 200.

The flat panel speaker apparatus 100B is disposed at a position reached by output waves outputted from the speaker apparatus 200, and reflects both the output waves Ow1 generated upon receiving the first audio signal In1 and the output waves Ow2 generated upon receiving the second audio signal In2. In the system constructed by the components shown in FIG. 10, the user U1 is positioned at a location reached by the sound waves outputted from the speaker apparatus 200 and the user U2 is positioned at a location reached by the sound waves reflected by the flat panel speaker apparatus 100B.

The flat panel speaker apparatus 100B has the same configuration as the apparatus shown in FIG. 5 and includes the delay unit 14, the transmission function correcting unit 15, the amplifier unit 12, the vibrator 30, and the vibration member 20. Only the first audio signal In1 outputted from the first sound source 1*a* is inputted into the delay unit 14.

Accordingly, in the flat panel speaker apparatus 100B, a predetermined delay is added to the first audio signal In1 by the delay unit 14, the signal is then corrected by the transmission function correcting unit 15, and the first audio signal In1 delayed and corrected is amplified at a predetermined amplification ratio by the amplifier unit 12. The audio signal In1 processed as described above is inputted into the vibrator 30 as the vibrator input signal, and the vibrator 30 is driven by the vibrator input signal and vibrates, with such vibration also being transmitted to the vibration member 20. By causing the vibration member 20 to vibrate, the output waves Ow3 are outputted from the flat panel speaker apparatus 100B.

That is, the amplitude of the output waves Ow3 outputted from the flat panel speaker apparatus 100B is larger than the amplitude of the output waves Ow1 outputted upon receiving the first audio signal In1. That is, a louder sound than the sound outputted via the speaker apparatus 200 alone is outputted.

On the other hand, the audio signal In2 outputted from the second sound source 1*b* is inputted into only the speaker apparatus 200. Accordingly, the output waves Ow2 outputted from the speaker apparatus 200 upon receiving the audio signal In2 are not subjected to the various types of signal processing by the flat panel speaker apparatus 100B. That is, when the output waves Ow2 corresponding to the second audio signal In2 reach the flat panel speaker apparatus 100B, the output waves Ow2 are simply (i.e., physically) reflected to produce the reflected waves Rw2.

Using such construction, the output waves Ow1 and the output waves Ow2 outputted from the speaker apparatus 200 reach the location of the user U1 at the position reached by only the audio outputted from the speaker apparatus 200. Also, the reflected waves Rw2 produced by physical reflection of the output waves Ow2 outputted from the speaker apparatus 200 and output waves Owa1 composed of the output waves Ow3 produced by the audio signal subjected to signal processing and the reflected waves Rw1 reach the user U2 positioned at a location reached by both the sound waves outputted from the speaker apparatus 200 and the sound waves reflected by the flat panel speaker apparatus 100B.

That is, sound produced by simply adding the audio signal In1 and the audio signal In2 will reach the user U1, and sound based on the audio signal In2 and sound based on a signal produced by amplifying the audio signal In1 will reach the user U2. That is, the audio that reaches the user U2 is louder than the audio that reaches the user U1.

According to the third embodiment described above, the flat panel speaker apparatus 100B can be used as an acoustic reflector that is capable of using different reflectance on a plurality of different audio signals.

It is also possible to change the volume of the sound at positions reached and positions not reached by the reflected waves produced by the flat panel speaker apparatus 100B.

Alternatively, by outputting different audio from the different sound sources, such as when BGM (BackGround Music) is outputted from the first sound source 1*a* and vocals are outputted from the second sound source 1*b*, it is possible to change the content of the sound that reaches different locations. By using such construction, it is possible to change the type of sound that reaches the user U according to the user U's preferences, such as by having audio with increased treble reach a user U who likes treble and audio with increased bass reach a user U who likes bass.

Here, by using a speaker with directionality, such as a directional loudspeaker or array speaker, as the speaker apparatus 200, it is possible to improve the sound separation at different positions reached by the sound waves.

Also, although an example where there are two sound sources 1 is given in the third embodiment described above, an embodiment of the present invention is not limited to this and it is also possible to apply an embodiment of the present invention to a construction with a different number of sound sources, such as three or four.

Also, although an example construction where only one audio signal out of the two audio signals outputted from the two sound sources 1 is inputted into the flat panel speaker apparatus 100B and subjected to signal processing such as the adding of a delay and correction of the transmission function has been given in the third embodiment described above, an embodiment of the present invention is not limited thereto. For example, it is also possible to use a construction where two audio signals are inputted into the flat panel speaker apparatus 100B and different amplification ratios are used on the respective audio signals.

Figure 11:
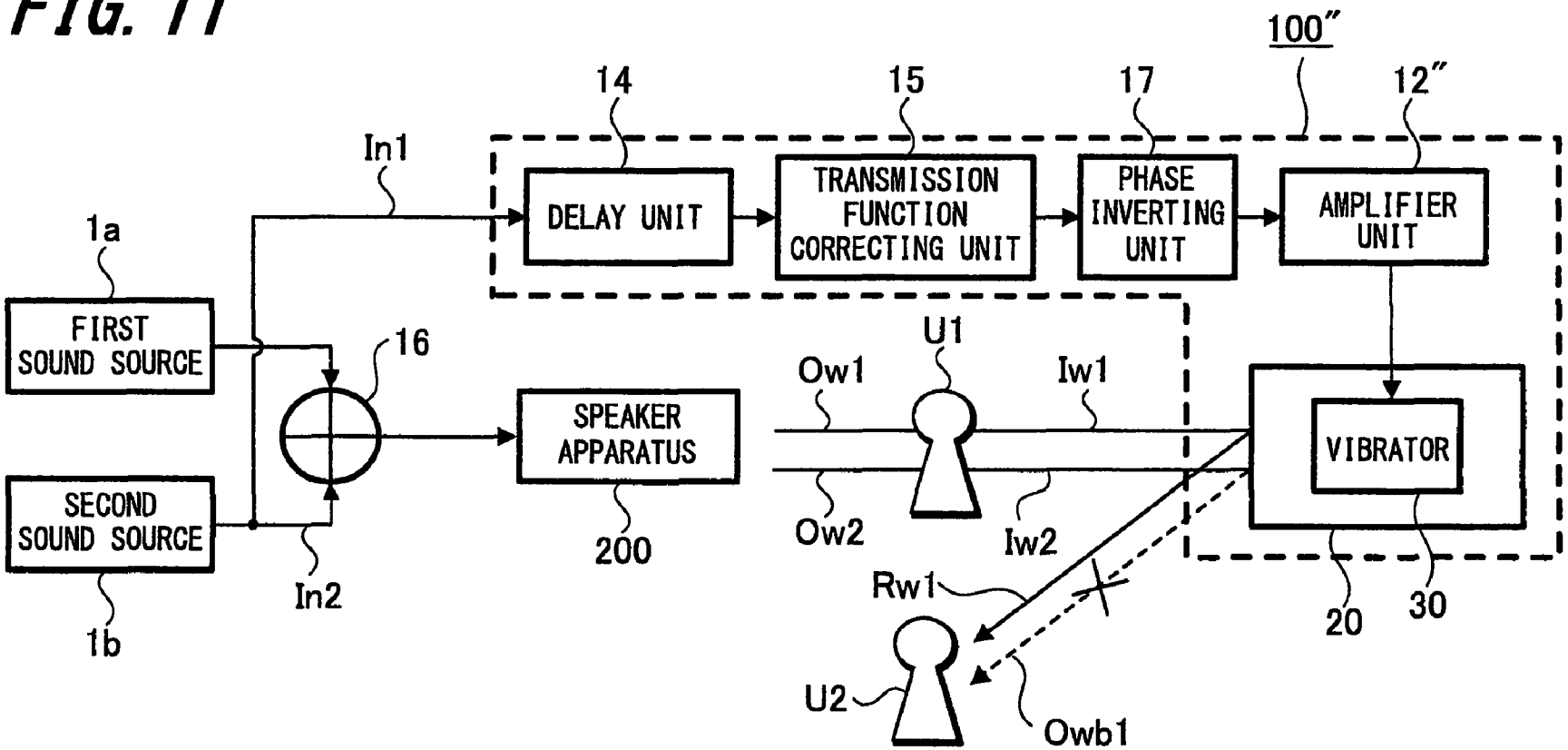
FIG. 11 is a diagram showing a modified example construction of a system according to a third embodiment of the present invention.

Also, although a construction where different reflectance are applied to a plurality of different audio signals is given in the third embodiment described above, it is also possible to use a construction where the reflectance applied to one of the audio signals is set at zero. An example of the system construction in such case is shown in FIG. 11. In FIG. 11, parts that correspond to parts in FIG. 10 have been assigned the same reference numerals.

The system shown in FIG. 11 includes the first sound source 1*a*, the second sound source 1*b*, the adding unit 16, the speaker apparatus 200, and the flat panel speaker apparatus 100". Since the first sound source 1*a*, the second sound source 1*b*, and the adding unit 16 have the same configurations as those shown in FIG. 10, description thereof is omitted here.

The flat panel speaker apparatus 100" is disposed in the same way as in FIG. 10. That is, the flat panel speaker apparatus 100" is disposed at a position reached by the output waves outputted from the speaker apparatus 200 and reflects the output waves Ow1 generated upon receiving the first input signal In1 and the output waves Ow2 generated upon receiving the second input signal In2. In a system including the components shown in FIG. 11, the user U1 is positioned at a location reached by only the sound waves outputted from the speaker apparatus 200 and the user U2 is positioned at a location reached by both the sound waves outputted from the speaker apparatus 200 and the sound waves reflected by the flat panel speaker apparatus 100".

The flat panel speaker apparatus 100" includes the delay unit 14, the transmission function correcting unit 15, a phase inverting unit 17, an amplifier unit 12", the vibrator 30, and the vibration member 20. Since the delay unit 14, the transmission function correcting unit 15, the vibrator 30, and the vibration member 20 have been described using the example shown in FIG. 10, description thereof is omitted here.

The phase inverting unit 17 carries out processing that inverts the phase of the inputted audio signal. Since an audio signal delayed by the delay unit 14 and corrected by the transmission function correcting unit 15 is inputted into the phase inverting unit 17, the phase inverting unit 17 inverts the phase of the audio signal to which such signal processing has been carried out. The audio signal whose phase has been inverted is outputted to the amplifier unit 12".

The amplifier unit 12" amplifies the audio signal outputted from the phase inverting unit 17 by an amplification ratio of one or below and outputs the amplified audio signal to the vibrator 30 as the vibrator input signal. Thus, the phase of the output waves generated by vibration of the vibrator 30 and the vibration member 20 is the inverse phase to the phase of the output waves outputted from the speaker apparatus 200. In addition, since the audio signal with the inverted phase has been amplified by an amplification ratio of one or below, the output waves Owb1 outputted from the flat panel speaker apparatus 100" will cancel out the sound waves Ow2 outputted from the speaker apparatus 200.

The example shown in FIG. 11 is constructed so that only the second audio signal In2 out of the audio signals outputted from the two sound sources 1 is inputted into the flat panel speaker apparatus 100". For this reason, the output waves Ow2 that transfer the audio signal In2 are cancelled out by the output waves Owb1 outputted from the flat panel speaker apparatus 100" and having an inverted phase to the output waves Ow2. That is, in terms of the second audio signal In2, the flat panel speaker apparatus 100" functions as a sound absorbing material.

Accordingly, the output waves Ow1 and the output waves Ow2 outputted from the speaker apparatus 200 reach the location of the user U1 positioned at a location only reached by the sound outputted from the speaker apparatus 200. Also, only the reflected waves Rw1 produced by the flat panel speaker apparatus 100" reflecting the output waves Ow1 reach the location of the user U2 positioned at a location that would normally be reached by both the sound waves outputted from the speaker apparatus 200 and the sound waves reflected by the flat panel speaker apparatus 100". That is, the type of audio that can be heard will change depending on the location at which the user U is positioned.

Figure 12:
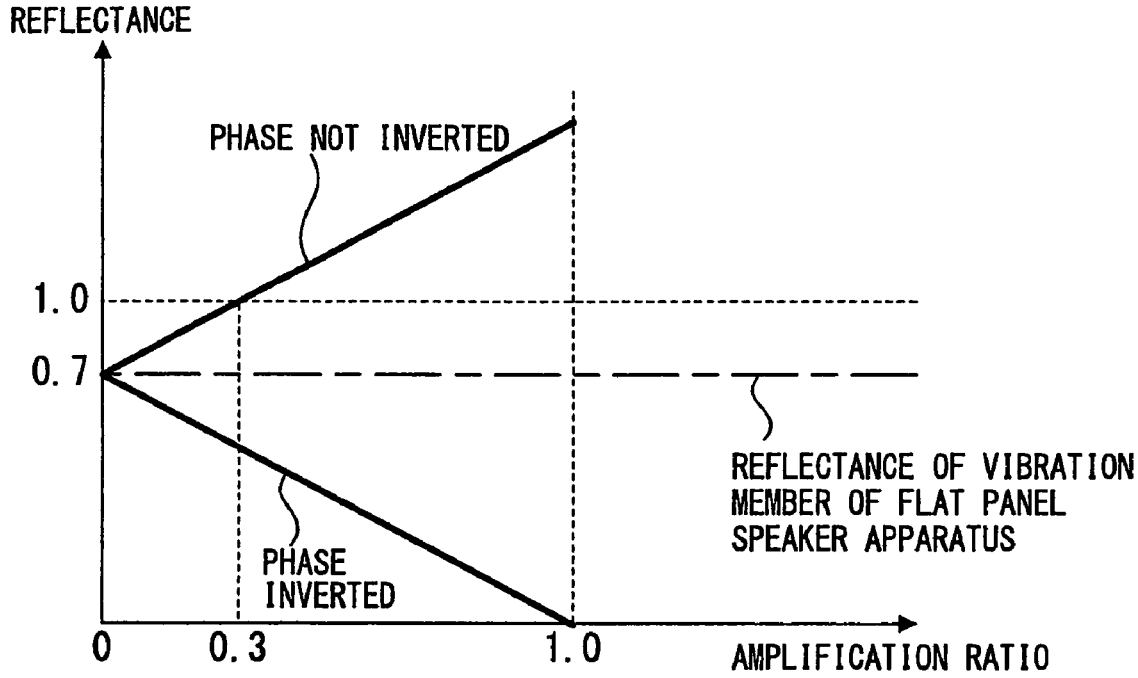
FIG. 12 is a characteristics graph showing the relationship between an amplification ratio and a reflectance according to an embodiment of the present invention.

The relationship between the amplification ratio of the amplifier unit 12" of the flat panel speaker apparatus 100" and the reflectance when the vibration member 20 functions as an acoustic reflector will now be described with reference to FIG. 12. FIG. 12 is a graph showing the reflectance on the vertical axis and the amplification ratio on the horizontal axis and shows examples of two patterns where the phase is inverted by the phase inverting unit 17 and where the phase is not inverted. In FIG. 12, as an example, it is assumed that the reflectance intrinsic to the vibration member 20 is 0.7.

As shown in FIG. 12, in the case where the phase inverting processing is carried out by the phase inverting unit 17, the reflectance is 0.7 when the amplification ratio is 0 and the reflectance is 0 when the amplification ratio is 1.0. When the amplification ratio is set at an intermediate value between such values, the reflectance is a value that is inversely proportional to the magnitude of the set amplification ratio. In the case where the phase inverting processing is not carried out by the phase inverting unit 17, the reflectance is 0.7 when the amplification ratio is 0 and the reflectance becomes 1.0 when the amplification ratio is 0.3. As the amplification ratio is increased thereafter up to 1.0, the reflectance also increases in proportion to such value.

That is, in the system shown in FIG. 11, by setting the amplification ratio of the amplifier unit 12" at a value that is one or below, it is possible to set the sound absorption coefficient for when the flat panel speaker apparatus 100" functions as a sound absorbing material at a desired value. Note that in the characteristics graph shown in FIG. 12, the region showing examples where phase inversion is not carried out shows the relationship between the amplification ratio and the reflectance in the first embodiment and the second embodiment described above.

According to a modified example of the third embodiment described above, by subjecting a specific audio signal to the phase inverting processing by the phase inverting unit 17 and amplification with an amplification ratio of one or below by the amplifier unit 12", it is possible to cause the flat panel speaker apparatus 100" to absorb the audio signal. That is, out of the audio signals outputted from the plurality of sound sources 1, it is possible to have the flat panel speaker apparatus 100" function as a sound absorbing material for a specific audio signal.

In this case, by setting the amplification ratio of the amplifier unit 12" at a value of one or below, it is possible to optionally change the sound absorption coefficient.

Also, according to the modified example of the third embodiment described above, it is possible to change the type of audio that reaches a position that is not a position reached by reflected waves produced by the flat panel speaker apparatus 100".

Next, a fourth embodiment of the present invention will be described with reference to FIGS. 13 and 14. The fourth embodiment is a construction where the flat panel speaker apparatus 100'" is caused to function as a sound absorbing material using a detection result for incident waves obtained by a microphone or an accelerometer.

Figure 13:
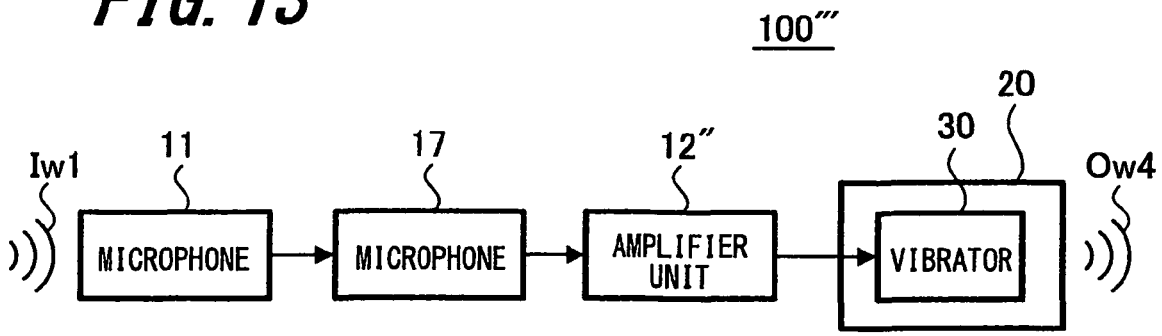
FIG. 13 is a block diagram showing an example of the internal configuration of a flat panel speaker apparatus according to a fourth embodiment of the present invention.

FIG. 13 is a block diagram showing an example of the internal configuration of the flat panel speaker apparatus 100'". The flat panel speaker apparatus 100'" shown in FIG. 13 includes the microphone 11, the phase inverting unit 17, the amplifier unit 12", the vibrator 30, and the vibration member 20.

In FIG. 13, parts that correspond to parts in FIGS. 2, 4, 5, 8, 11, and 12 have been assigned the same reference numerals. In the flat panel speaker apparatus 100'" shown in FIG. 13, the microphone 11 picks up the incident waves Iw1 incident on the vibration member 20, converts the waves Iw1 to an audio signal and outputs the audio signal to the phase inverting unit 17.

The phase inverting unit 17 converts the phase of the audio signal outputted from the microphone 11 and outputs the results to the amplifier unit 12". The amplifier unit 12 amplifies the audio signal whose phase is inverted by the phase inverting unit 17 by an amplification ratio of one or below and inputs the amplified signal into the vibrator 30 as the vibrator input signal.

The vibrator 30 is driven by the vibrator input signal and vibrates, with such vibration also being transmitted to the vibration member 20. Due to the vibration member 20 vibrating, the output waves Ow4 are outputted from the flat panel speaker apparatus 100'". Since the phase of the output waves Ow4 is the inverse phase to the output waves from the speaker apparatus 200 (i.e., the incident waves Iw1 on the vibration member 20), by outputting the output waves Ow4 from the flat panel speaker apparatus 100'", the output waves from the speaker apparatus 200 will be cancelled out. That is, the flat panel speaker apparatus 100'" also functions as a sound absorbing material that absorbs the incident waves.

Figure 14:
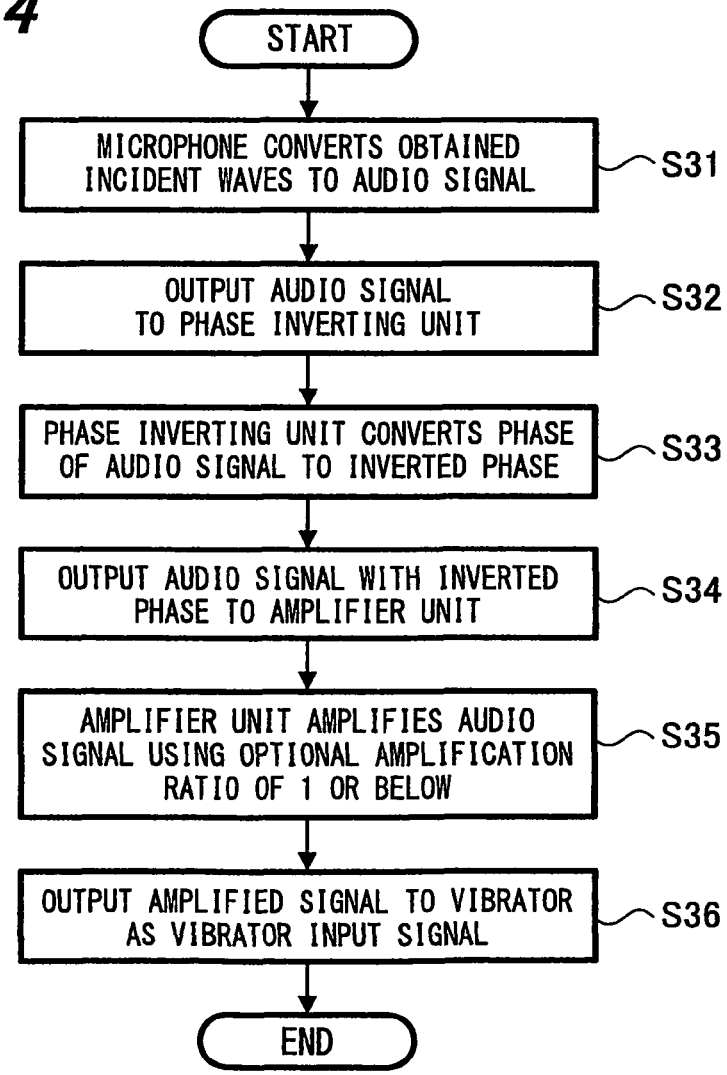
FIG. 14 is a flowchart showing an example of vibrator input signal generating processing according to a fourth embodiment of the present invention.

FIG. 14 is a flowchart showing an example of processing from the detection of the incident waves Iw1 by the microphone 11 to the generation of the vibrator input signal. First, the incident waves Iw1 are detected by the microphone 11 and converted to an audio signal (step S31) and the generated audio signal is outputted to the phase inverting unit 17 (step S32). The phase inverting unit 17 converts the phase of the audio signal to the inverse phase (step S33) and the audio signal whose phase has been inverted is outputted to the amplifier unit 12" (step S34).

The amplifier unit 12" amplifies the audio signal by any amplification ratio of one or below (step S35) and the amplified audio signal is outputted as a vibrator input signal to the vibrator 30 (step S36).

According to the fourth embodiment described above, it is possible to cause the flat panel speaker apparatus 100'" to function as a sound absorbing material. In this case also, in the same way as the third embodiment and the modification thereof, by adjusting the amplification ratio of the amplifier unit 12", it is possible to adjust the sound absorption coefficient.

Note that the series of processing by the first to fourth embodiments described above can be carried out by hardware or can also be carried out by software. When the series of processing is carried out by software, a program constituting such software is installed from a program recording medium into a computer in which a program constituting the software is incorporated in dedicated hardware or into a general purpose computer, for example, that is capable of various types of functions when various types of program are installed.

Figure 15:
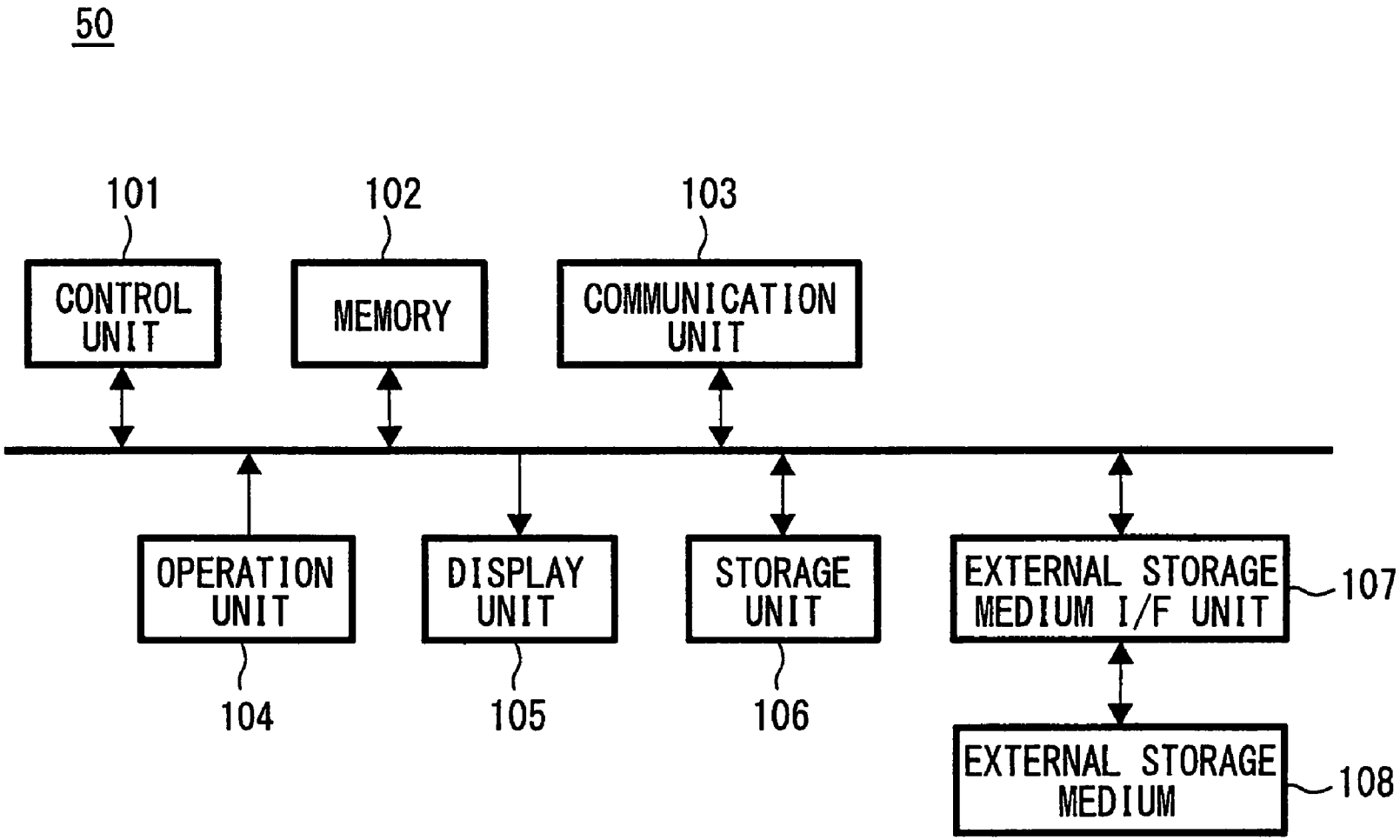
FIG. 15 is a block diagram showing an example of the internal configuration of a personal computer.

FIG. 15 shows an example configuration of a personal computer 50 (hereinafter simply "PC 50") capable of executing the series of processing in the embodiments described above according to a program. The PC 50 shown in FIG. 15 includes a control unit 101, a memory 102, a communication unit 103, an operation unit 104, a display unit 105, a storage unit 106, an external storage medium I/F unit 107, and an external storage medium 108.

The control unit 101 includes a CPU (Central Processing Unit) or the like, and carries out the series of processing described above or other types of processing in accordance with a program recorded in the memory 102 or the storage unit 106. The memory 102 includes a RAM (Random Access Memory) and/or ROM (Read Only Memory), and stores programs carried out by the control unit 101, data, or the like.

The communication unit 103 carries out communication with an external apparatus via a network such as the Internet or a local area network. When the external storage medium 108 such as a magnetic disk, an optical disc, a magneto-optical disc, or a semiconductor memory has been loaded in the external storage medium I/F unit 107, the external storage medium 108 is driven to obtain the program, data, or the like recorded on the external storage medium 108. Programs, data and the like that have been obtained are also transferred as necessary to the external storage medium 108 and recorded.

The operation unit 104 includes a keyboard, mouse, or the like. The operation unit 104 generates an operation signal in accordance with an operation input from the user and outputs the operation signal to the control unit 101. The display unit 105 is a display such as a CRT (Cathode Ray Tube) or an LCD (Liquid Crystal Display). The storage unit 106 includes a hard disk drive or a DVD (Digital Versatile Disc), for example, and records programs executed by the control unit 101 or various types of data.

As shown in FIG. 15, a program recording medium storing a program installed inside a computer and executable by the computer is configured as the external storage medium 108. The external storage medium 108 may include a removable medium such as the magnetic disc described above and also the memory 102, the storage unit 106, or the like that records a program distributed to the user in a state where the program has already been incorporated into the apparatus main body.

As necessary, the storing of a program in the program recording medium is carried out using a wired or wireless communication medium, such as a local area network, the Internet, or a digital satellite broadcast, via the communication unit 103 that is an interface such as a router or a modem.

Note that in the present specification, the processing steps that write a program stored in the program recording medium may be sequentially carried out in the order in which the processes are written, but need not be sequential processes and may be executed in parallel or individually (for example, processing by parallel processing or processing by objects).

Also, the program may be processing carried out by a single computer or may be distributed processing carried out by a plurality of computers. In addition, the program may be transferred to and executed by a remote computer.

It should be understood by those skilled in the art that various modifications, combinations, sub-combinations and alterations may occur depending on design requirements and other factors insofar as they are within the scope of the appended claims or the equivalents thereof.

What is claimed is:

1. An audio signal output apparatus comprising:

a driving unit configured to receive incident waves and generate a driving signal with the same phase as the incident waves; and an output unit configured to be driven by the driving signal and output waves with the same phase as the incident waves, wherein the output unit is formed of a vibration member and includes a vibrator that causes the vibration member to vibrate, wherein the incident waves are sound waves incident on the vibration member out of sound waves outputted from a speaker apparatus provided separately from the audio signal output apparatus, and wherein the vibration member is configured to reflect the incident waves.

2. An audio signal output apparatus according to claim 1, wherein the driving unit includes an amplifier unit configured to amplify the driving signal by an optional amplification ratio.

3. An audio signal output apparatus according to claim 2, further comprising:

a delay unit configured to add a predetermined delay set in advance to the audio signal inputted into the speaker apparatus and output the delayed audio signal.

4. An audio signal output apparatus according to claim 3, wherein the delay added by the delay unit is decided based on an adjustment time for setting a time, from input of an audio signal inputted to the speaker apparatus into the delay unit to output from the vibration member of output waves generated from the audio signal to which the delay is added by the delay unit, equal to a time taken for the output waves outputted from the speaker apparatus to be incident on and reflected by the vibration member.

5. An audio signal output apparatus according to claim 3, further comprising a transmission function correcting unit configured to correct a signal outputted from the delay unit using a transmission function set in advance and output the corrected signal to the vibrator.

6. An audio signal output apparatus according to claim 2, further comprising:

an incident wave obtaining unit configured to obtain the incident waves and convert the incident waves to a signal in accordance with the size of the obtained incident waves.

7. An audio signal output apparatus according to claim 6, further comprising a second delay unit configured to add an optional delay to a signal generated by the incident wave obtaining unit and output the delayed signal to the driving unit.

8. An audio signal output method for use with an audio signal output apparatus, said method comprising the steps of:

receiving incident waves and generating a driving signal with the same phase as the incident waves by use of a driving unit; and outputting waves with the same phase as the incident waves according to driving by the driving signal by use of an output unit, wherein the output unit is formed of a vibration member and includes a vibrator that causes the vibration member to vibrate, wherein the incident waves are sound waves incident on the vibration member out of sound waves outputted from a speaker apparatus provided separately from the audio signal output apparatus, and wherein the vibration member is configured to reflect the incident waves.

9. A computer-readable recording medium on which is recorded a program for causing a computer to control an audio signal output apparatus to carry out the steps of:

receiving incident waves and generating a driving signal with the same phase as the incident waves by use of a driving unit; and outputting waves with the same phase as the incident waves according to driving by the driving signal by use of an output unit, wherein the output unit is formed of a vibration member and includes a vibrator that causes the vibration member to vibrate, wherein the incident waves are sound waves incident on the vibration member out of sound waves outputted from a speaker apparatus provided separately from the audio signal output apparatus, and wherein the vibration member is configured to reflect the incident waves.

* * * * *